United States Patent [19]

Bodine

[11] 4,236,580

[45] Dec. 2, 1980

[54] METHOD AND APPARATUS FOR SONICALLY EXTRACTING OIL WELL LINERS

[76] Inventor: Albert G. Bodine, 7877 Woodley Ave., Van Nuys, Calif. 91406

[21] Appl. No.: 893,339

[22] Filed: Apr. 4, 1978

[51] Int. Cl.[2] ..... E21B 31/00

[52] U.S. Cl. ..... 166/301; 166/177; 175/56

[58] Field of Search ..... 166/301, 286, 177, 98; 173/49; 175/55, 56; 294/86.23, 86.15, 86.25; 214/308

[56] References Cited

U.S. PATENT DOCUMENTS

| | | | |
|---|---|---|---|
| 463,048 | 11/1891 | Hanlen | 294/86.25 |
| 2,139,076 | 12/1938 | Gates | 166/301 |
| 2,808,887 | 10/1957 | Erwin | 166/177 X |
| 2,842,207 | 7/1958 | Alexander | 166/301 |
| 2,972,380 | 2/1961 | Bodine, Jr. | 166/301 |
| 2,998,067 | 8/1961 | Kerver | 166/301 |
| 3,023,811 | 3/1962 | Green | 166/98 X |
| 3,217,803 | 11/1965 | Winger | 166/301 |
| 3,268,003 | 8/1966 | Essary | 166/301 X |
| 3,399,724 | 9/1968 | Brooks | 166/301 X |

FOREIGN PATENT DOCUMENTS

| | | | |
|---|---|---|---|
| 522824 | 6/1940 | United Kingdom | 294/86.15 |

*Primary Examiner*—James A. Leppink
*Assistant Examiner*—Richard E. Favreau
*Attorney, Agent, or Firm*—Edward A. Sokolski

[57] ABSTRACT

A column of elastic material such as steel is lowered into an oil well by means of a derrick to a position such that the end portion thereof is within a liner to be removed. The end portion of the column has clamping means thereon which are employed to tightly clamp the column to the liner. High level and variable resonant sonic energy is then applied to the column from the surface and transmitted along the column to the liner. The sonic energy operates to loosen the liner from the surrounding earthen material which usually has an adhesive tarry substance which tightly holds the liner. Vertical bias force, which may be varied from time to time to apply variable bias both upwardly and downwardly, as well as torsional bias in some instances are employed to aid in loosening the liner, the sonic energy operating to hysteresis heat the tarry adhesive until it softens and the liner can be removed by drawing the column upwardly with the derrick.

7 Claims, 6 Drawing Figures

METHOD AND APPARATUS FOR SONICALLY EXTRACTING OIL WELL LINERS

This invention relates to a method and apparatus for extracting oil well liners, and more particularly to such a method and apparatus employing sonic energy in its implementation.

In some instances in the construction or "completion" of an oil well, they arrange the final lower portion with a "liner" that is in effect a downward extension of the lower end of the main casing string. This liner is of smaller diameter so that it may be subsequently lowered down inside of the previously installed main casing string, and lowered beyond the casing string, until there is only a small portion of the liner still overlapping in telescoping manner at the lower end of the casing string so as to establish a tight connection. Very often a wedge type of "hanger" joint is used at the overlap, so as to permanently position the liner, at least initially; and sometimes a packer ring seal is used at the overlapping joint.

One of the purposes of this liner technique is to permit drilling the well and installing the main casing down to the oil bearing formation while using a high performance or minimum expensive drilling mud which might be somewhat incompatible with the physical chemistry of the oil bearing formation. Then the bottom of the casing string is cemented off at the top of the oil bearing formation. From this point on a smaller drill bit is lowered down inside of the casing string, and the well bore drilling is continued on down into the oil bearing formation while using a special drill mud that will not cause swelling and damage the porosity, etc., of the oil bearing formation. Upon completion of this drilling, the above mentioned "liner" is then lowered down inside of the main casing and installed as above mentioned so as to provide permanent support for the walls of the well bore in the oil producing interval. Sometimes an underreaming drill bit is first used to enlarge the bore hole around the liner so that a layer of gravel can be pumped into permanent installation around the outside of the liner.

One primary purpose of this separate liner element of casing, intended only for the producing interval, is to make possible the accurate pre-cutting of narrow fine slot perforations before installation so that this liner can function as a fine screen to exclude the entry of loose sand into the well bore. For example, when not using liners, the main well casings are simply installed the entire distance, and the casing is subsequently gun perforated to provide large holes therein.

With the passage of time these fine liner slots become clogged with oil residue, or they corrode out from the passage of salt water. Moreover, the region immediately outside of the liner becomes clogged up with various residues. Since the earth develops a tight grip on these liners, they are generally impossible to remove. Therefore, a good oil well has to be put back into normal operation by an expensive process of cutting a side window slot in the main casing string above the liner and then drilling and completing a slant well extension alongside the old plugged off liner.

In my U.S. Pat. No. 2,972,380, issued Feb. 21, 1961, a method is described whereby sonic energy can be utilized to loosen pipe from oil wells. This technique involves the transmission of high level resonant sonic energy down the casing string to the member to be removed. The present invention provides an improvement over the technique of my aforementioned prior patent which is particularly suited for the removal of oil well liners from the remote ends of casing strings without disturbing the casing string itself. The technique and apparatus of the present invention also affords improved means for expediting the loosening of the liner from the earthen formation by virtue of apparatus and a technique whereby vertical and/or torsional bias applied to the liner is varied from time to time.

I have found that a special sonic technique can be used to remove the original liner so that the lower end of the well can be rehabilitated far more economically. My sonic technique can remove the old liner, and can install a new one in its place. The special feature of my new system deals with the fact that practically the entire length of the liner is uniquely gripped by an adhesive tar-like substance that has peculiar transitory gripping characteristics that can be momentarily loosened by proper application of sonic power.

I lower an elastic column into the well that has a reactive impedance not too different from that of the liner. The oscillator then "sees" the resistive impedance of the tarry adhesion existing over the main length of the liner. This gives an optimum energy flow so that the sonic energy is converted into hysteresis heating of the tarry adhesive, so that the latter softens and becomes more like a lubricant. The removed liners have the appearance of a lubricated coating.

In aid of this energy flow I find a surprisingly augmented performance if the vertical bias is changed, or if torque is applied, from time to time. This apparently establishes new attitudes of coupling into the tar around the liner, so as to combat the troublesome acoustic decoupling effect of localized shear planes that become established around the liner during any particular sustained bias environment. In other words, with bias sustained at one particular value for a long time interval during the application of my system, the earth apparently stabilizes and develops a gripping effect which defeats the desired objective. Changing the bias from time to time effectively avoids this problem. At least this is my theory why this unique approach of changing the bias is so unexpectedly helpful for liner pulling, as compared to the more general usage of loosening of a casing or a drill pipe fish as shown in my U.S. Pat. No. 2,972,380. Casing strings and drill pipes are not in a fairly unitary environment throughout their lengths, such as the well liners here being considered.

It is therefore an object of this invention to facilitate the removal of clogged or damaged oil well liners without disturbing the casing string.

It is a further object of this invention to provide an improved method and apparatus for extracting oil well liners.

It is a further object of this invention to improve the efficiency of the sonic extraction of oil well liners by providing means for applying varying amounts of vertical and torsional bias on the liners during such operation.

Other objects of this invention will become apparent as the description proceeds in connection with the accompanying drawings, of which:

Figure 1:
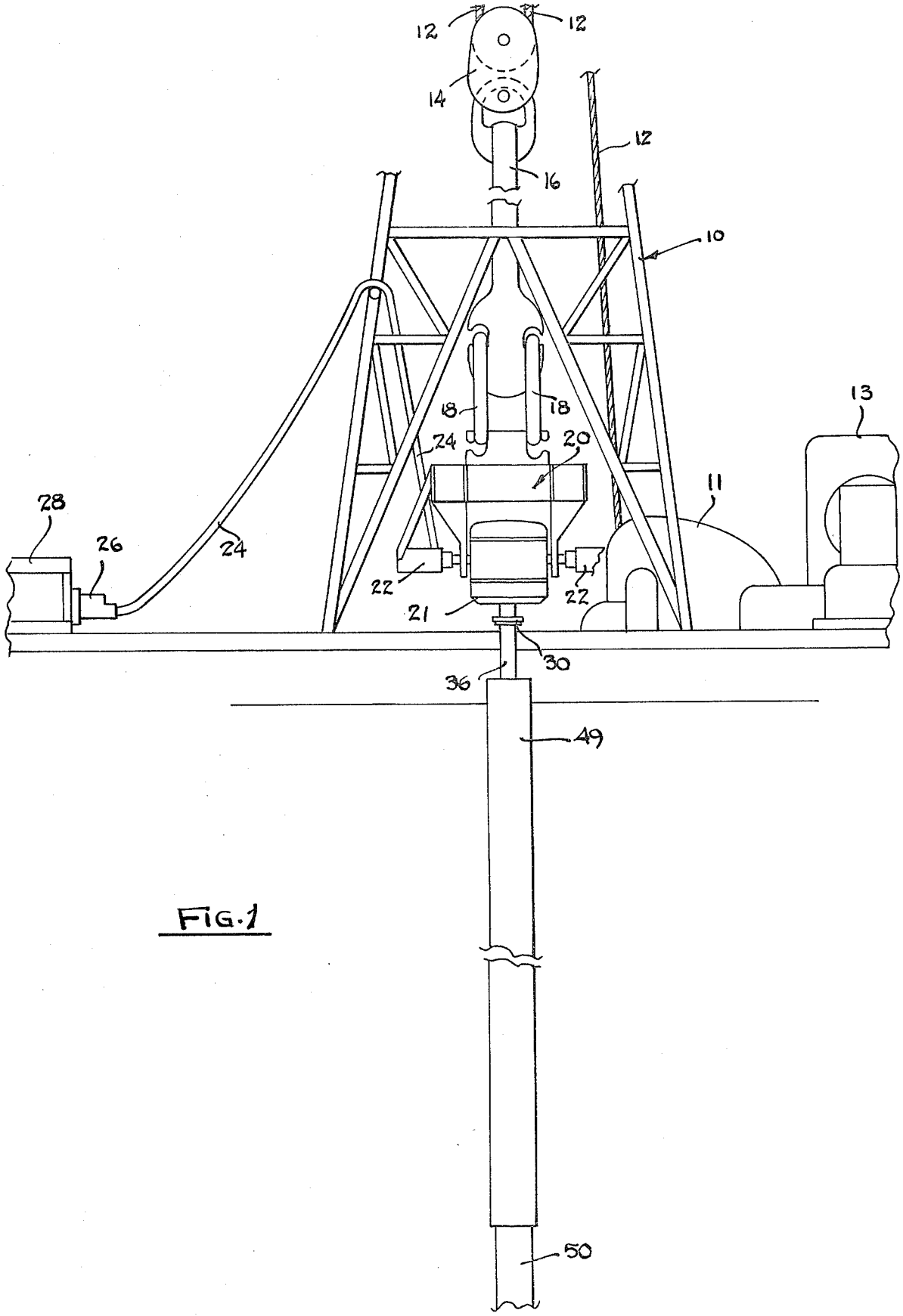
FIG. 1 is an elevational view illustrating a derrick mechanism and sonic drive device which may be used in various embodiments of the invention.

It has been found most helpful in analyzing the device of this invention to analogize the acoustically vibrating circuit utilized to an equivalent electrical circuit. This sort of approach to analysis is well known to those skilled in the art and is described, for example, in Chapter 2 of "Sonics" by Hueter and Bolt, published in 1955 by John Wiley and Sons. In making such an analogy, force F is equated with electrical voltage E, velocity of vibration u is equated with electrical current i, mechanical compliance $C_m$ is equated with electrical capacitance C, mass M is equated with electrical inductance L, mechanical resistance (friction) $R_m$ is equated with electrical resistance R and mechanical impedance $Z_m$ is equated with electrical impedance $Z_e$.

Thus, it can be shown that if a member is elastically vibrated by means of an acoustical sinusoidal force $F_o \sin \omega t$ ($\omega$ being equal to $2\pi$ times the frequency of vibration), that $$Z_m = R_m + j(\omega M - \frac{1}{\omega C_m}) \quad (1)$$

Where $\omega M$ is equal to $1/\omega C_m$, a resonant condition exists, and the effective mechanical impedance $Z_m$ is equal to the mechanical resistance $R_m$, the reactive components $\omega M$ and $1/\omega C_m$ cancelling each other out. Under such a resonant condition, velocity of vibration is at a maximum, power factor is unity, and energy is more efficiently delivered to a load to which the resonant system may be coupled.

It is important to note the significance of the attainment of high acoustical "Q" in the resonant system being driven to increase the efficiency of the vibration thereof and to provide a maximum amount of power. As for an equivalent electrical circuit, the "Q" of an acoustically vibrating system is defined as the sharpness of resonance thereof and is indicative of the ratio of the energy stored in each vibration cycle to the energy used in each such cycle. "Q" is mathematically equated to the ratio between $\omega M$ and $R_m$. Thus, the effective "Q" of the vibrating system can be maximized to make for highly efficient, high-amplitude vibration by minimizing the effect of friction in the system and/or maximizing the effect of mass in such system.

In considering the significance of the parameters described in connection with equation (1), it should be kept in mind that the total effective resistance, mass, and compliance in the acoustically vibrating system are represented in the equation and that these parameters may be distributed throughout the system rather than being lumped in any one component or portion thereof.

It is also to be noted that orbiting-mass oscillators are utilized in the implementation of the invention that automatically adjust their output frequency and phase to maintain resonance with changes in the characteristics of the load. Thus, in the face of changes in the effective mass and compliance presented by the load with changes in the conditions of the work material as it is sonically excited, the system automatically is maintained in optimum resonant operation by virtue of the "lock-in" characteristics of the applicant's unique orbiting-mass oscillators. Furthermore, in this connection the orbiting-mass oscillator automatically changes not only its frequency but its phase angle and therefore its power factor with changes in the resistive impedance load, to assure optimum efficiency of operation at all times. The vibrational output from such orbiting-mass oscillators also tends to be constrained by the resonator to be generated along a controlled predetermined coherent path to provide maximum output along a desired axis.

Some oil well liners apparently have a variety of binding agents around the outside surface. At least I have noted a tendency of some liners to come loose in stages so to speak. This seems to give stepwise change for the terminal impedance of the very localized bottom end of the long elastic column. Liners are peculiarly short in relation to the total wave transmission column. Such step change of impedance can apparently be accommodated by changing the vibratory amplitude at a resonant frequency by varying the engine torque. Also I have found that varying the frequency is very beneficial in hastening the loosening of certain liner situations. Again I believe that this effectiveness is due to the characteristic of the different layers of tarry binding agent around the outside of the liner.

Briefly described, my invention is as follows: An elastic column which may be fabricated of a material such as steel, and having a clamping mechanism on its lower end, is lowered by means of a derrick into an oil well casing string down to the liner to be removed with the clamping mechanism within the liner. The clamping mechanism is then operated to tightly engage the walls of the liner. High level sonic energy is then applied to the column, preferably to set up resonant standing wave vibration along the column with an antinode of such vibration pattern appearing in the region of the clamping mechanism. Varying amounts of both upward and downward vertical bias and torsional bias may be applied to the casing during the application of the sonic energy. The sonic energy operates to hysteresis heat adhesive material such as tar, which may be retaining the liner in the surrounding earthen material, thereby softening such adhesive material and in many instances converting it into a lubricant. The sonic energy further operates to vibratorily pulverize surrounding earthen material to loosen the liner therefrom. The application of varying amounts of vertical and torsional bias from time to time greatly facilitates the loosening of the liner by avoiding a stabilizing and resultant gripping effect of the surrounding material encountered with sustained fix bias. Finally, when the liner has been sufficiently loosened, the column is drawn upwardly by means of the derrick with which it was lowered, the liner thereby being removed from the oil well casing.

In the implementation of the present invention, a derrick and a sonic drive unit such as described in my U.S. Pat. No. 3,684,037 issued Aug. 15, 1972, and my U.S. Pat. No. 3,189,106 issued June 15, 1965, may be employed and the specifications of these two patents are hereby incorporated by reference into the present application.

Referring now to FIG. 1, a pictorial view of the base of a derrick and a sonic drive unit which may be utilized in implementing the invention are illustrated. The sonic drive unit and derrick may be of the type described in my aforementioned U.S. Pat. Nos. 3,189,106 and 3,684,037. Derrick 10 has at the top thereof (not shown) a standard crown block sheave (not shown) over which cable 12 is strung in multiple loops so as to provide support and pull-up (typically over 100,000 pounds) on travelling block 14. Cable 12 is wound on the drum of draw mechanism 11 which is driven by engine 13. Travelling block 14 carries swivel 16 which has pull links 18 from which sonic drive unit 20, much like that shown in my U.S. Pat. No. 3,189,106, is suspended. Sonic drive unit 20 includes a housing 21 in which an orbiting-mass oscillator (not shown) for generating sonic vibratory energy and an air spring isolator mechanism (not shown) are contained. By virtue of the spring isolator mechanism, sonic output flange 30 is enabled to deliver powerful sonic vibrations to column 36 without having these vibrations delivered to the main drive unit 20 or any part of the assembly connected to rig 10. Also and more importantly, in view of my use of varying bias, the isolation means enables the delivery of various amounts of pull-up bias to transmission column 36 from draw mechanism 11 via cable 12, swivel 16, links 18 and sonic drive unit 20. The oscillator and air spring mechanism are fully described in my U.S. Pat. Nos. 3,189,106 and 3,684,037, which are incorporated herein by reference.

As can be seen from U.S. Pat. Nos. 3,189,106 and 3,684,037, internal to the sonic oscillator there is a torque reaction available to be applied through flange 30. The torque reaction can be applied to column 36 so as to provide torque bias from the lower end of column 36.

The oscillator unit contained within housing 21 is rotatably driven by hydraulic motors 22 which receive their hydraulic power through hose 24 from hydraulic power pump 26 which is driven by engine 28. Flange 30 receives the vibrational output of the drive unit and from this flange the vibrational energy is coupled to transmission column 36 which is fabricated of an elastic material such as steel. The vibrational output is transmitted to column 36 in a mode of vibration such as to cause longitudinal vibration thereof, i.e., along the longitudinal axis of the column. The frequency of oscillation of the oscillator of the drive unit is preferably adjusted so as to cause resonant standing wave vibration of column 36. This high level sonic energy is transmitted down the column and coupled to the well liner 50 to be removed, as to be fully described in connection with FIGS. 2–5.

While the sonic energy is being applied to the liner, various amounts of vertical bias is intermittently applied to column 36 by changing the lift on the column applied to sonic drive unit by means of derrick 10, as to be described in connection with FIGS. 2–5. Also, a torque bias is applied to column 36 from the sonic drive unit, this torque being developed in the drive unit as described starting in the last paragraph of Column 11 of my aforementioned U.S. Pat. No. 3,189,106. It is to be noted that the air spring isolator contained in housing 21 effectively prevents the vibrational energy from being dissipated in the support members of drive unit 20, yet at the same time provides effective coupling of both vertical and torsional bias to column 36.

Figure 2:
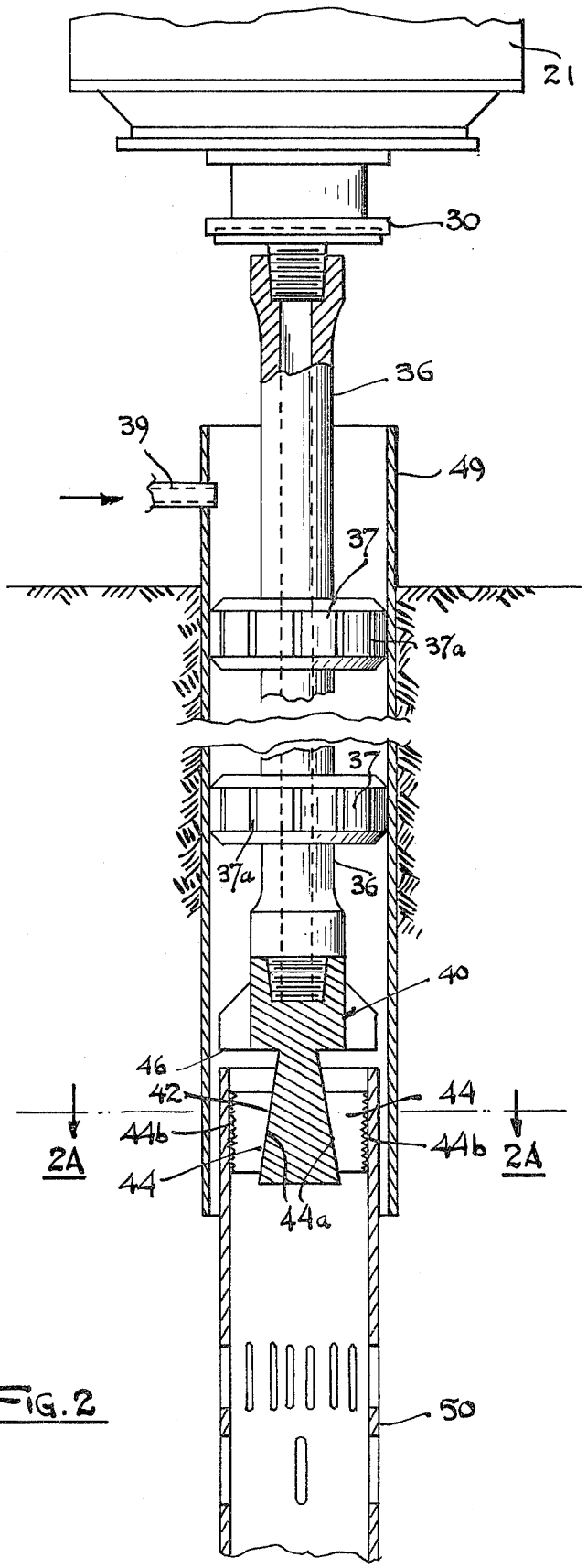
FIG. 2 is an elevational view in corss section of a first embodiment of the invention.

Referring now to FIG. 2, a first embodiment of the invention is illustrated. Elastic column 36 is lowered into well casing 49 down to well liner 50 which is to be removed. Attached to the very end of column 36 is a coupling tool 40 which has a wedge member 42 at the extreme end thereof, this wedge member being in the shape of a conical section. A pair of slip jaws 44 are slidably supported on member 42, these slip jaws having half conical inner surfaces **44*a* which matingly engage the conical walls of member 42. Jaws 44 have outer serrated wall portions 44*b*** which are generally semicircular in form.

After jaws 44 have been lowered to within liner 50, column 36 is drawn upwardly by means of the derrick, thereby causing member 42 to urge the jaws apart against the inner walls of liner 50 until the serrated wall portions **44*b* are in tight engagement against the liner walls. To insure tight engagement between jaws 44 and the liner, it is essential that a minimum upward bias be applied to column 36, this bias being great enough so that at no time during the vibrational cycle of the sonic energy applied to the column will this upward bias go below the minimum value, this to assure that the sonic energy will not disengage the jaws from the liner. The amount of upward bias supplied is varied from time to time while sonic energy is being applied to column 36, this bias variation operating to more effectively utilize the sonic energy in loosening liner 50 from the earthen and tarry material in which it is held. Varying amounts of downward bias can also be applied to the liner while sonic energy is being applied, by relaxing the pull on cable 12 sufficiently so that a substantial portion of the weight of column 36 is set down on the top of liner 50 with flange portion 46 of tool 40** abutting against the liner top edge.

I have found that with some oil wells, particularly wells that have been operated for some time in conjunction with steam flood technique as an artificial stimulant for increasing the oil production, the liner becomes locked very tightly in place as a result of very fine sand becoming packed around the outer surface of the liner. These kinds of wells require that very substantial sonic horsepower be applied in connection with the specially fluctuated sonic environment of this invention as explained above. In some instances this high horsepower transmission requires special consideration because the sonic power is being transmitted down a slender column, such as drill pipe, which column is hanging more or less freely inside of the main casing of the well. The peculiar feature of this invention is that it is always applied to liners, and liners to which the sonic energy is transmitted are always at the bottom end of the well casing. Therefore, the power transmission column is within the open environment of the well casing.

Because this system employs longitudinal wave action in the transmission column the latter is subjected to alternate tension and compression force components. And, such a column located freely within an open casing is very prone to engender buckling vibration which causes damaging lateral or bending vibration. I have discovered that this unwanted vibration can be ameliorated by proper lateral constraint of the transmission column. Rubber bumpers or rings 37 of somewhat doughnut shape located at spots along column 36 are employed to provide guidance stability for the column, effectively acting as bumpers from the inner walls of casing 49. I prefer to have these bumpers closely fitting the inside diameter of the casing, the outer walls of the bumpers having vertical grooves **37*a* formed therein to allow fluids to pass freely through the annulus. Also I prefer having these bumpers spaced along the column with the spacing distance between bumpers being no greater than one-eighth wave length for the longitudinal sonic pattern being transmitted down column 36. Conduit 39 may be used to introduce lubricant into casing 49** as may be necessary for lubricating the bumpers.

When the downward bias is sufficient to maintain strong frictional engagement of shoulder 46 against the top edge of liner 50, or the upward bias is at a sufficiently high level so as to maintain jaws 44 in tight engagement against the inner walls of liner 50, rotary torque bias can be effectively utilized simultaneously with the application of longitudinal bias, which can be very effective in combination with the sonic energy for loosening the liner. Varying amounts of rotary torque are provided in the output of sonic drive unit 21 as described in the paragraph starting at the bottom of Column 11 of my aforementioned U.S. Pat. No. 3,189,106.

In certain situations, it may be desirable to eliminate flange 46 so as to permit the tool to be lowered a substantial distance down within liner 50 so that the jaws 44 may engage the liner further down therein for more effective loosening thereof.

Figure 5:
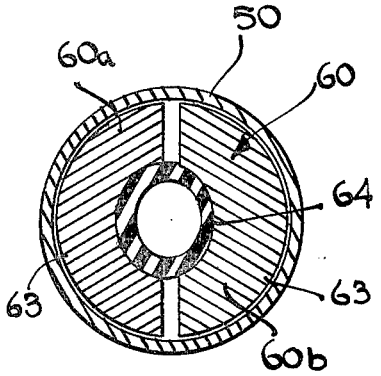
FIG. 5 is a cross sectional view taken along the plane indicated by 5—5 in FIG. 4.
Figure 2A:
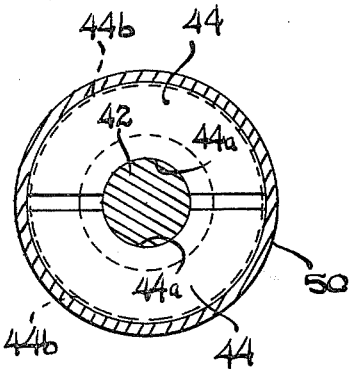
Figure 3:
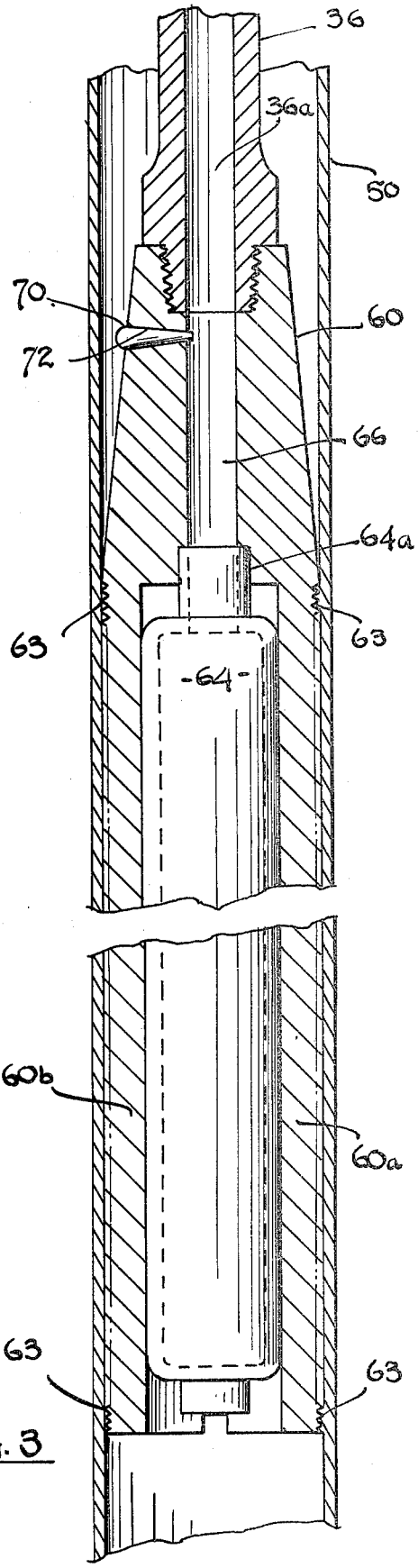
FIG. 3 is an elevational view in cross section of a second embodiment of the invention shown in tight engagement against the wall of an oil well liner.
Figure 4:
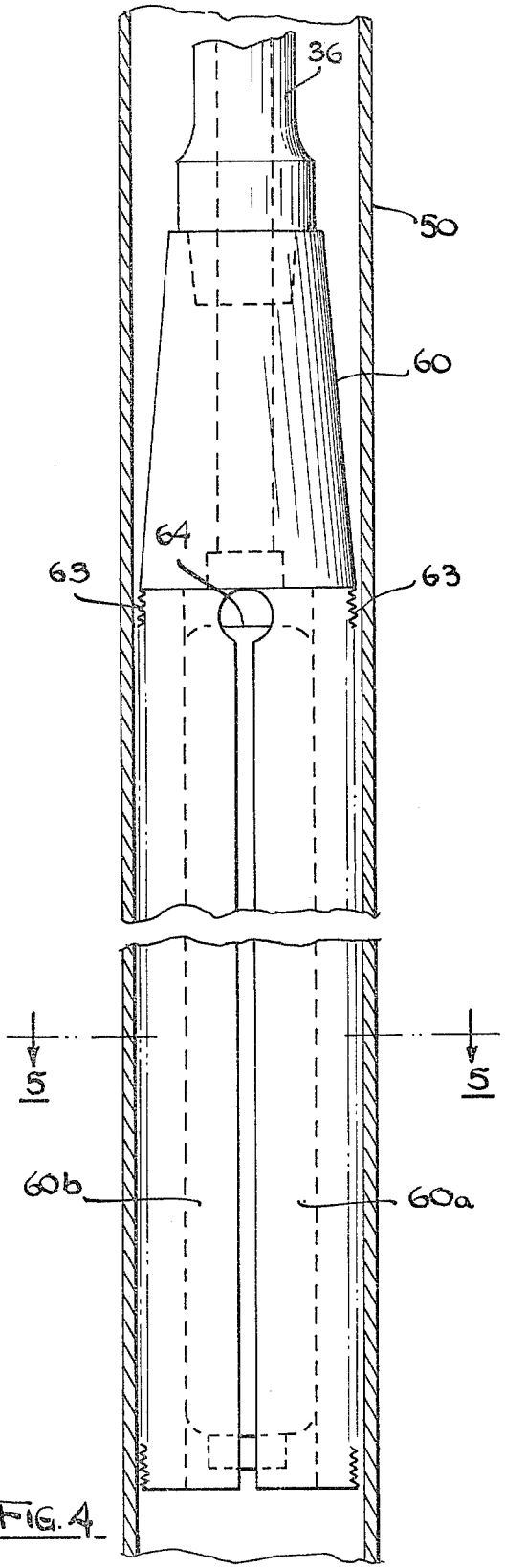
FIG. 4 is an elevational view illustrating the second embodiment not in engagement with an oil well liner.

Referring now to FIGS. 3–5, a second embodiment of the invention is illustrated. This second embodiment is especially useful for removing relatively delicate liners that have become weakened by downhole corrosion and require a greater clamping area in their removal. Mandrel 60 of an elastic material such as steel is fixedly attached to the end of elongated column 36. Mandrel 60 has a plurality of gripping teeth 63 which are used to grip the inner wall of liner 50. Mandrel 60 functions as an extension of column 36 such that sonic energy can be transferred therefrom into a substantial extent of the liner, rather than being concentrated in one locale as in the previous embodiment. The total energy thus is distributed over the liner, thus avoiding concentration of high energy in one point which might damage the liner and complicate its removal.

Mandrel 60 has a pair of spreadable split leg portions **60*a* and 60*b*, which form a hollow chamber into which high pressure expandable bladder member 64 is installed. Bladder member 64 is made of an expandable material such as a suitable rubber or plastic and has an inlet 64*a* through which fluid may be passed to its interior. Inlet 64*a* is in fluid communication with passageway 66 formed in mandrel 60**.

The second embodiment is utilized in the following manner. With bladder 64 deflated, i.e., without any liquid being forced therein under pressure (as shown in FIGS. 4 and 5), column 36 and mandrel 60 are lowered down the oilwell casing in the same manner as described for the first embodiment, until mandrel 60 is fully down within the well liner 50 to be removed. Liquid is then introduced into passageway **36*a* formed in column 36 and thence through passageway 66 into the interior of bladder member 64. The liquid introduced into column 36 develops a high hydrostatic pressure, particularly in view of the depth of the well, this causing expansion of bladder 64 which drives the legs 60*a* and 60*b* outwardly into firm engagement with the inner walls of liner 50. FIGS. 4 and 5 illustrate bladder 64 in its unexpanded condition prior to the introduction of fluid therein, while FIG. 3** shows the bladder in its expanded condition with the mandrel legs firmly in engagement with the liner.

With the mandrel in firm engagement with the liner, high level sonic energy is applied to column 36, as for the first embodiment, while various amounts of upward and downward bias as well as torsional bias may be periodically applied to effect the loosening of the liner. Mandrel 60 provides a very effective sonic energy transmitting termination for sonic column 36, and a good reinforcing backbone for a flimsy liner. Moreover, since it is always in good acoustic coupling relationship with liner 50 there is no need for maintaining minimum upward or downward bias.

Normally, the liner or a segment thereof is removed from the ground along with the mandrel. However, if it is desired for any reason to remove the mandrel separately, i.e. to disengage the mandrel from the liner, this end result can be achieved by dropping a "go devil" bar down passageway **36*a* which strikes the end of taper pin 70 with sufficient force to drive this taper pin out of hole 72 in which it is inserted. The hydrostatic pressure is thus released through aperture 72, thereby releasing the pressure in bladder 64 permitting legs 60*a* and 60*b* to return to their non-spread position (as shown in FIGS. 4 and 5**).

While the invention has been described and illustrated in detail, it is to be clearly understood that this is intended by way of illustration and example only and is not to be taken by way of limitation, the spirit and scope of this invention being limited only by the terms of the following claims.

I claim:

1. A method for removing an oil well liner lodged at the bottom of an oil well casing comprising the steps of:

lowering an elastic elongated column having a clamping tool at the bottom end thereof through said casing until said clamping tool is within said liner.

tightly clamping said tool to said liner, coupling high level sonic energy to said column to cause longitudinal vibration thereof, said sonic energy being coupled through said tool to said liner, while the sonic energy is being continually coupled to said liner, simultaneously and continuously applying varying amounts of vertical bias force to said liner through said column, said bias force being changed from time to time, and when said liner is freed from the formation drawing it out from said well.

2. The method of claim 1 wherein varying torsional bias force is additionally applied to said liner while the sonic energy is being coupled thereto.

3. The method of claim 1 wherein the sonic energy is at a frequency such as to cause resonant standing wave vibration of said column.

4. The method of claim 1 wherein said tool comprises a pair of slip jaws slidably fitted over a wedge member fixedly attached to the column, said jaws being clamped to said liner by drawing upwardly on said column after the tool has been lowered into said liner.

5. The method of claim 1 wherein said tool comprises a pair of expandable legs and an expandable bladder fitted between said legs, said legs being clamped to said liner by forcing fluid into the bladder to expand the bladder and drive the legs apart after the tool has been lowered into said liner.

6. The method of claim 1 wherein the sonic energy is generated by means of an orbiting-mass oscillator coupled to said elastic column and rotatably driven by a prime mover, the torque of said prime mover and the speed of said oscillator being varied while the tool is being clamped to said liner.

7. The method of claim 1 wherein the column is lowered a substantial distance down within said liner and clamped thereto at said substantial distance, the liner thereby being more effectively loosened.

* * * * *